US010996025B2

(12) United States Patent
Gillins

(10) Patent No.: US 10,996,025 B2
(45) Date of Patent: May 4, 2021

(54) ARCHERY TARGET RANGEFINDER

(71) Applicant: Reggie Gillins, Kanab, UT (US)

(72) Inventor: Reggie Gillins, Kanab, UT (US)

( * ) Notice: Subject to any disclaimer, the term of this patent is extended or adjusted under 35 U.S.C. 154(b) by 281 days.

(21) Appl. No.: 16/275,094

(22) Filed: Feb. 13, 2019

(65) Prior Publication Data

US 2019/0249954 A1 Aug. 15, 2019

Related U.S. Application Data

(60) Provisional application No. 62/631,396, filed on Feb. 15, 2018.

(51) Int. Cl.
*F41G 1/467* (2006.01)
*F41G 3/06* (2006.01)

(52) U.S. Cl.
CPC ..... *F41G 3/06* (2013.01)

(58) Field of Classification Search
CPC ..... F41G 1/467
USPC ..... 33/265; 124/87
See application file for complete search history.

(56) References Cited

U.S. PATENT DOCUMENTS 2,574,599 A * 11/1951 Stieber ..... F41G 1/467 124/23.1
4,689,887 A * 9/1987 Colvin ..... F41G 1/467 124/87
4,915,088 A * 4/1990 Powers ..... F41G 1/467 124/87
5,094,002 A * 3/1992 Saunders ..... F41G 1/467 33/265
7,886,448 B2 * 2/2011 Humpert ..... F41G 1/467 33/265
8,365,423 B2 * 2/2013 Humpert ..... G01C 3/00 33/265
2003/0233757 A1 * 12/2003 Nordberg ..... F41G 1/467 33/265
2004/0006879 A1 * 1/2004 Afshari ..... F41G 1/467 33/265
2009/0007446 A1 * 1/2009 Humbert ..... F41G 1/467 33/265
2009/0178287 A1 * 7/2009 Humbert ..... F41G 1/467 33/265
2010/0000103 A1 * 1/2010 Humbert ..... F41G 1/467 33/265
2011/0120438 A1 * 5/2011 Samuels ..... G01C 3/06 124/87
2013/0067755 A1 * 3/2013 Maynard ..... F41G 1/467 33/228
2013/0247399 A1 * 9/2013 Evans ..... F41G 1/467 33/265
2015/0267998 A1 * 9/2015 Grace, Jr. ..... F41C 23/16 42/117

* cited by examiner

*Primary Examiner* — George B Bennett
(74) *Attorney, Agent, or Firm* — Gurr Brande & Spendlove, PLLC; Robert A. Gurr

(57) ABSTRACT

A non-electronic rangefinder assembly has a rectangular block, a bracket, and a means for coupling to a riser of a bow. The rectangular block features a selection of markings, including notches, in the body that correspond to distances to a target for predetermined targets. The rectangular block may be removed from the bracket (attached to the bow riser) to allow other rectangular blocks, corresponding to other targets, to be attached to the bracket for use.

5 Claims, 7 Drawing Sheets

ARCHERY TARGET RANGEFINDER

CROSS-REFERENCE TO RELATED APPLICATIONS

This application claims the benefit of U.S. Provisional Application Ser. No. 62/631,396, filed on Feb. 15, 2018, which is incorporated herein by reference.

TECHNICAL FIELD

The present disclosure relates to rangefinders for archery. More particularly, the present disclosure relates to a rangefinder tool for archery that attaches to the riser of a bow and facilitates determining distance from the archer's location to that of the intended target.

BACKGROUND

The art and practice of archery has existed for thousands of years. Every archer is faced with the necessary challenge and obligation of being skilled at determining the distance from their location to that of their intended target to be optimally successful in hitting that target. Due to the physical nature of the release and flight of the arrow, should an archer plan an arrow flight trajectory for 35 yards, and the target is 40 yards away, this discrepancy can, and will, generally lead to the archer missing the target completely. Modern advances in technology and archery tools have made the practice of judging target distance much easier, and more accurate, yet these modern aids still have limitations and will not work in every target encounter. Problems with current range-finding technology and tools include: imprecise measurements, especially due to not being draw specific (bowstring); limited ranging distance (generally only up to 50 yards); limited position utilization; limited adjustability of the range-finding instrument; and limited breadth of application for specific animal and object targets. Furthermore, today's electronic rangefinders can be hampered by clouded and/or fragile lenses, operating malfunctions, errors or inconsistencies, the requirement to have power (e.g., batteries), and general level of expense and upkeep. Accordingly, there is a need for a rangefinder that does not require a power source, that does not require a lens, is not complex to use, and that is inexpensive. The present invention seeks to solve these and other problems.

SUMMARY OF EXAMPLE EMBODIMENTS

In one embodiment, a rangefinder assembly comprises a substantially rectangular block with a flat lateral side (distal from the bow riser) and a side with a threaded bolt (proximal to the riser and inserted into a bracket mounted against the bow riser). The top side of the rectangular block comprising a selection of markings, notches, or other apertures that are pre-calculated and set to match with the size of a specific target animal (e.g., mature mule deer) at a particular orientation (e.g., broadside) at particular distances, such as 20 yards, 30 yards, 40 yards, 50 yards, 60 yards, and even 70 yards, for the specified (bowstring) draw length of the user. The bottom side of the rectangular block rangefinder comprises markings, notches, or other apertues pre-calculated and set to match the same type of target (e.g., mature mule deer), albeit at a different target orientation, such as conditions wherein the target is facing the archer directly head-on or directly away from the archer. The rectangular block, via a threaded bolt screw, is coupled to a bracket to stabilize the rangefinder against the bow riser. The bracket may be coupled to the bow riser in a variety of manners, such as by threading into the riser, adhesive, hook and loop, or by using an elastic o-ring.

In some embodiments, the specific range-finding markings and notches of the rectangular block will be calculated and custom applied for the desired target and desired distances of the user for a particular hunt or particular purpose, such as for hunting mule deer. In some embodiments, the specific range-finding markings and notches can be calculated and custom applied for alternative selected targets and distances, for hunting mule deer, whitetail deer, elk, pronghorn antelope, moose, or other potential hunt objectives and targets.

BRIEF DESCRIPTION OF THE DRAWINGS

Some embodiments of the present invention are illustrated as an example and are not limited by the figures of the accompanying drawings or by the depictions in accompanying photo pages. The figures are illustrative of invention functionality and are not necessarily to actual scale.

DETAILED DESCRIPTION OF EXAMPLE EMBODIMENTS

Figure 1:
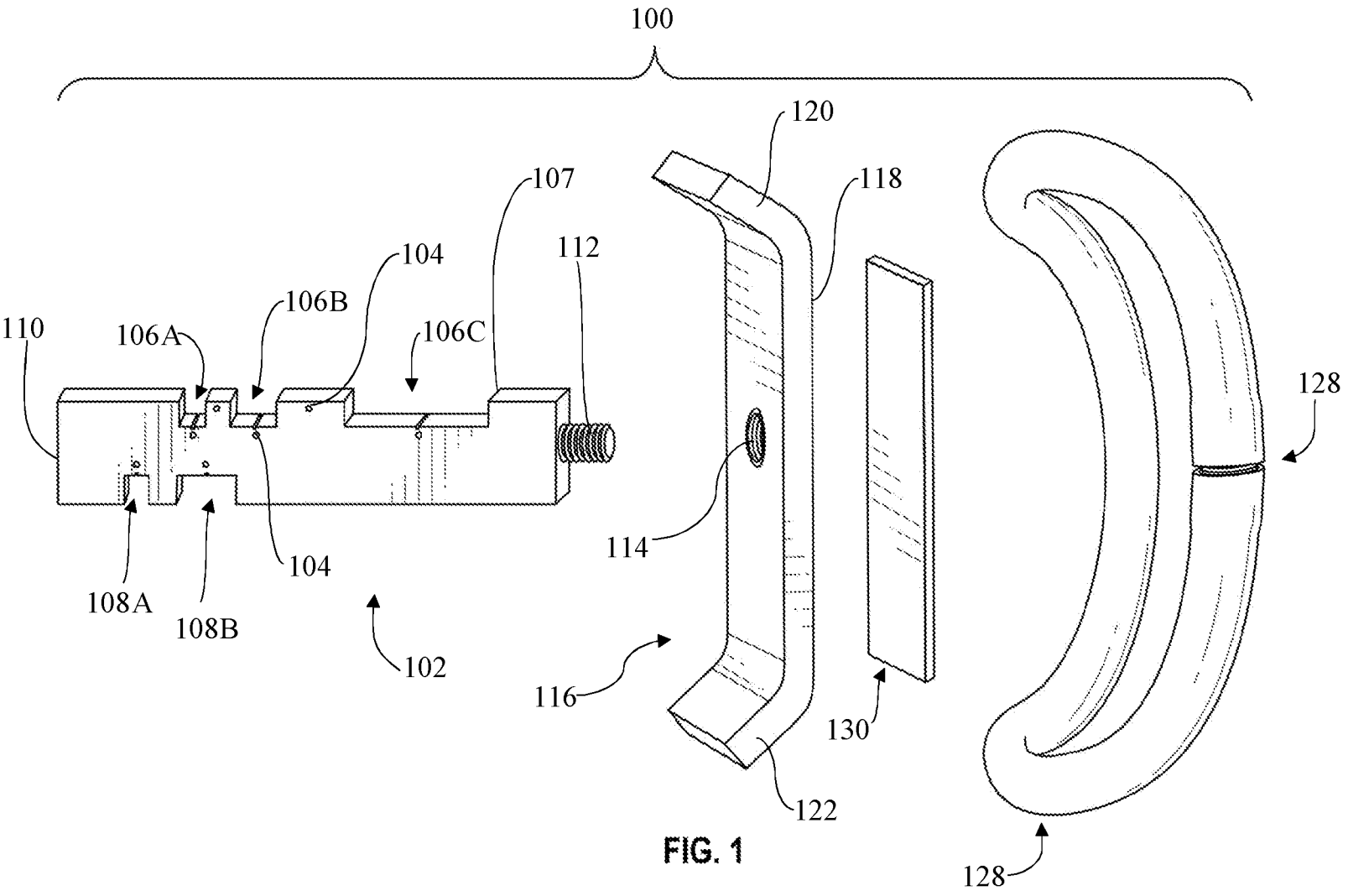
FIG. 1 is a perspective view of a rangefinder assembly, disassembled.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a commercial and practical need for a rangefinder that does not require a power source, that does not require a lens, is not complex to use, and that is inexpensive. The rangefinder disclosed herein affords a novel, inexpensive, and readily-implemented tool that allows users to incorporate a quick way to accurately calculate distance-to-target while accommodating and being optimized for the specific characteristics of the target (e.g., type and size of animal, distance) and for the specific characteristics of the user (e.g., height, bowstring draw distance). The present invention features a simple, small, non-electronic rangefinder tool that may be set for specific targets and specific distances of the user/hunter's preference to allow enhanced performance and reliability with high ease of use at a very low comparative cost.

As depicted in FIG. 1, in one embodiment, a rangefinder assembly 100 comprises a rectangular block 102, which may be made of metal (e.g., steel, titanium, tungsten alloy, aluminum), or other durable, weather-resistant and relatively stable and inflexible materials, including plastic, acrylic, carbon composite material or wood. The rectangular block 102 comprises markings 104 and one or more top notches 106A, 106B, 106C along the top side and one or more notches 108A, 108B along the bottom side. Each of these notches 106A-C, 108A-B, has been pre-calculated and preset to coordinate and correspond with various select target distances and various target animal and/or target object dimensions. The basis for these calculations shall be further detailed below. Notches 106A-C may be placed and arranged, in one embodiment, along the top side of a rectangular block 102 to properly correspond to distances of 60 to 70 yards, 40 to 50 yards, and 20 to 30 yards, respectively, and to targeting for the broadside of a mature mule deer. Further, as an example, the notches 108A-B along the bottom edge of the rectangular block 102 may be placed and arranged to properly correspond to distances of 40-50 yards or 20 to 30 yards, respectively, and to targeting for a mature mule deer situated facing head-on (frontal) or directly away (or quartering away) from the user targeting that deer. In one embodiment, the notches 106A-C, 108A-B have right-angle rectangle cuts or omissions into the rectangular block 102, with the bottom of each notch 106A-C, 108A-B being parallel to the top and bottom edges of the rectangular block 102. In another embodiment, the notches 106A-C, 108A-B may have one or more slopes from one end of the notch 106A-C, 108A-B to the other end of the notch 106A-C, 108A-B and thus not completely line up in parallel with the top and bottom edges of the rectangular block 102. In another embodiment, the notch 106A-C, 108A-B may feature an irregular shape that does not correlate with the top or bottom edge in a systematic fashion. In another embodiment, the rectangular block 102 may lack any notches and may, instead, rely on markings 104. In one embodiment, the rectangular block may not comprise any markings or notches, allowing for a user to add custom notches (such as by cutting) or markings for their intended use.

As further depicted in FIG. 1, the rectangular block 102 features a straight edge 110 on the distal end farthest from the bow when in practical use. This straight edge 110 of the distal end serves as an initial reference point for sighting and assessing target distance measurements. The rectangular block 102 also features a threaded protrusion 112 at the opposite, proximate end (closest to the bow) when in practical use. This threaded protrusion 112 is suitable and compatible for operable attachment to a threaded female receiver 114 centrally incorporated into a bracket 116. In one embodiment, the rectangular block 102 may be adjusted along a left-to-right dimension by adjusting the threaded protrusion 112 in complete revolutions to laterally move the rectangular block 102 in the direction preferred by the user.

In one embodiment, the bracket 116 is composed of metal, such as steel or titanium, yet this bracket may also be composed of other weather-resistant and relatively stable and substantially inflexible materials, including acrylic, hard plastic, or wood. This bracket 116 is substantially a rectangular structure in its primary medial body section 118, suitable for stable alignment against the riser of a bow, yet the two opposing distal ends 120, 122 of the bracket 116 project or bend at an angle inward toward the rectangular block 102 and outward away from the axis of the bow riser to facilitate operable attachment of an o-ring 124 (or other flexible rubber toroid structure). See FIG. 6 for an example. Returning to FIG. 1, the o-ring 124 may be disconnectable, such as by using a threaded coupler 128 (or solid insert within a tube structure), although not required. In other words, the o-ring may be a continuous piece of material. Further, while the examples shown herein contemplate the use of an o-ring or other elastomer, it will be appreciated that other mechanisms for securing the bracket 116 to the riser 126 may be used. For example, the bracket 116 may be coupled to the riser 126 using adhesives, hooks and loops, snaps, screws, or any other fastener. However, it will be appreciated that the elastomer (e.g., o-ring 124) allows for the bracket 116 to be easily coupled and de-coupled from the riser 126 without damaging the riser 126.

Further, the rangefinder assembly 100 may comprise a bracket pad 130. The bracket pad 110 is inserted between the bracket 116 and the riser 126 of the bow to protect the bow riser 126 from scratches or other damage from direct contact with the bracket 116. The bracket pad 130 may be made of suitable materials, such as felt fabric or flexible polyvinyl chloride (foam rubber). In one embodiment, the bracket 116 may comprise felt, fabrics, foam, rubber, or other combination to prevent damage to the riser 126, in which case the bracket pad 130 may be omitted.

As discussed in detail above, the rangefinder assembly 100 is directed to helping the user accurately determine the distance between the user and the animal or object target. The rangefinder of the present invention mounts to the riser 126 of a user's bow, thus allowing for an accurate and consistent measurement from the user's eye to the rangefinder assembly 100 when calculating distance to target. The formula W/L=H/D will assist in determinations of distance to target, wherein L is the distance from the user's eye to the rectangular block 102, D is the distance from the user to target, H is a known dimension of the target, for example, the distance from front shoulder to hind end of a target mature mule deer (in this specific example, the distance, and corresponding value of H, is 38 inches). W (width) is the measurement observed at time of target selection on the rangefinder (e.g., the measurement observed when the broadside of a mature mule deer is sighted).

As a hypothetical calculation for W, H is set at 38 inches, i.e., the distance from shoulder to hind end of a mature mule deer. The user is 20 yards from the mule deer at the time of sighting, and thus D is 20 yards. L, the distance from the user's eye to the rangefinder itself, might be 28 inches should the measured draw length (of the bowstring) for the archer equal 29 inches. In this case, W=1 15.3/32 inches. Consequently, for this hypothetical user, a notch 106C ends at position 107 on the top side of the rectangular block 102 at 1 15.3/32 inches from the flat, distal end 110 of the rectangular block 102 to signify a determination of 20 yards distance between the user and the target mule deer. In other words, the first end of the mule deer is placed at distal end 110, with the second end of the mule deer terminating at 107. To continue with this hypothetical, if the distance is, in fact, farther, the perceived distance across the rectangular block 102 will be less than 1 15.3/32 inches; conversely, if the distance is less than 20 yards, the perceived distance across the rectangular block 102 will equal greater than 1 15.3/32 inches.

Figure 7:
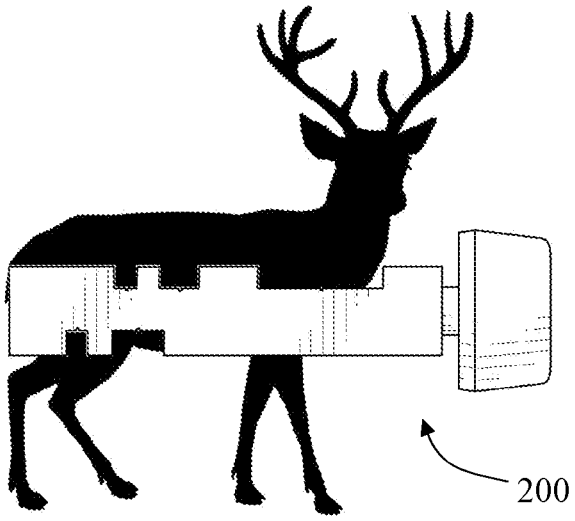
FIG. 7 is a front elevation view of a rangefinder assembly in use to determine the distance of a buck.
Figure 8:
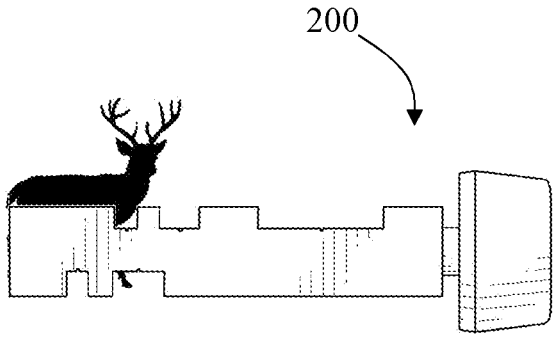
FIG. 8 is a front elevation view of a rangefinder assembly in use to determine the distance of a buck.

Based on the format of the foregoing calculations, similar calculations and marks or notches may be made on the rectangular block 102 that correspond to distances of, e.g., 30, 40, 50, 60 or 70 yards from user to target. For example, FIG. 7 illustrates a buck at a close distance (e.g., 20-yards), while FIG. 8 shows a buck at a greater distance (e.g., 50 yards), the buck aligning with notches of the rangefinder assembly 200. It will be appreciated that the beginning, middle, and end of each notch may correspond to certain distances.

For the example above, this rectangular block 102 would be specifically set up for an archer with a 29-inch bowstring draw length and for a mature mule deer. As such, the markings 104 and notches 106A-C, 108A-B signifying specific distances to the target for this rectangular block 102 would not properly correspond for users with other working draw lengths or for other targets of differing build and size (e.g., a whitetail deer rather than a mule deer).

To expand more generally from this specific example, rectangular blocks 102 for archers of differing draw lengths and for different target animals can readily be assembled and properly marked using the same calculations and construction detailed above. For example, embodiments of the invention may include rectangular blocks designed and intended for archers with draw lengths ranging from 24 inches to 33 inches and embodiments of the invention may be set up and marked for targeting such different animals as elk, whitetail deer, and other big game animal species. Embodiments of the invention may include rectangular blocks set and oriented for left-handed archers. Assorted rectangular blocks of the invention can be easily removed and replaced or reapplied dependent on the specific, current targeting objectives of the archer or the differing characteristics or different targeting objectives of different archers using the same bow. For example, the user could simply unscrew the rectangular block for mule deer and screw in a rectangular block for elk. Similarly, the rectangular block can easily be adjusted up or down along the riser of the bow to suit the different eye level or height of different archers by disengaging the flexible o-ring 124, adjusting the bracket 116 along the bow riser 126, and re-engaging the flexible ring 124.

Archers using the rangefinder assembly 100 would observe and understand the markings 104 and notches 106A-C, 108A-B of their chosen rectangular block 102, would be able to then sight the target, and by sight aligning the target with the distal end 110 with the proper initial measurement point of the target, determine the target distance by observing how the target in sight aligns and measures against the corresponding markings 104 and notches 106A-C, 108A-B of the rangefinder. To a certain extent, the notches 106A-C, 108A-B may also be relied upon even when the animal is quartering. However, it will be appreciated that the notches may be varied in anticipation of such scenarios. Accordingly, the rectangular block may have a variety of notches for varied uses and circumstances.

Figure 2:
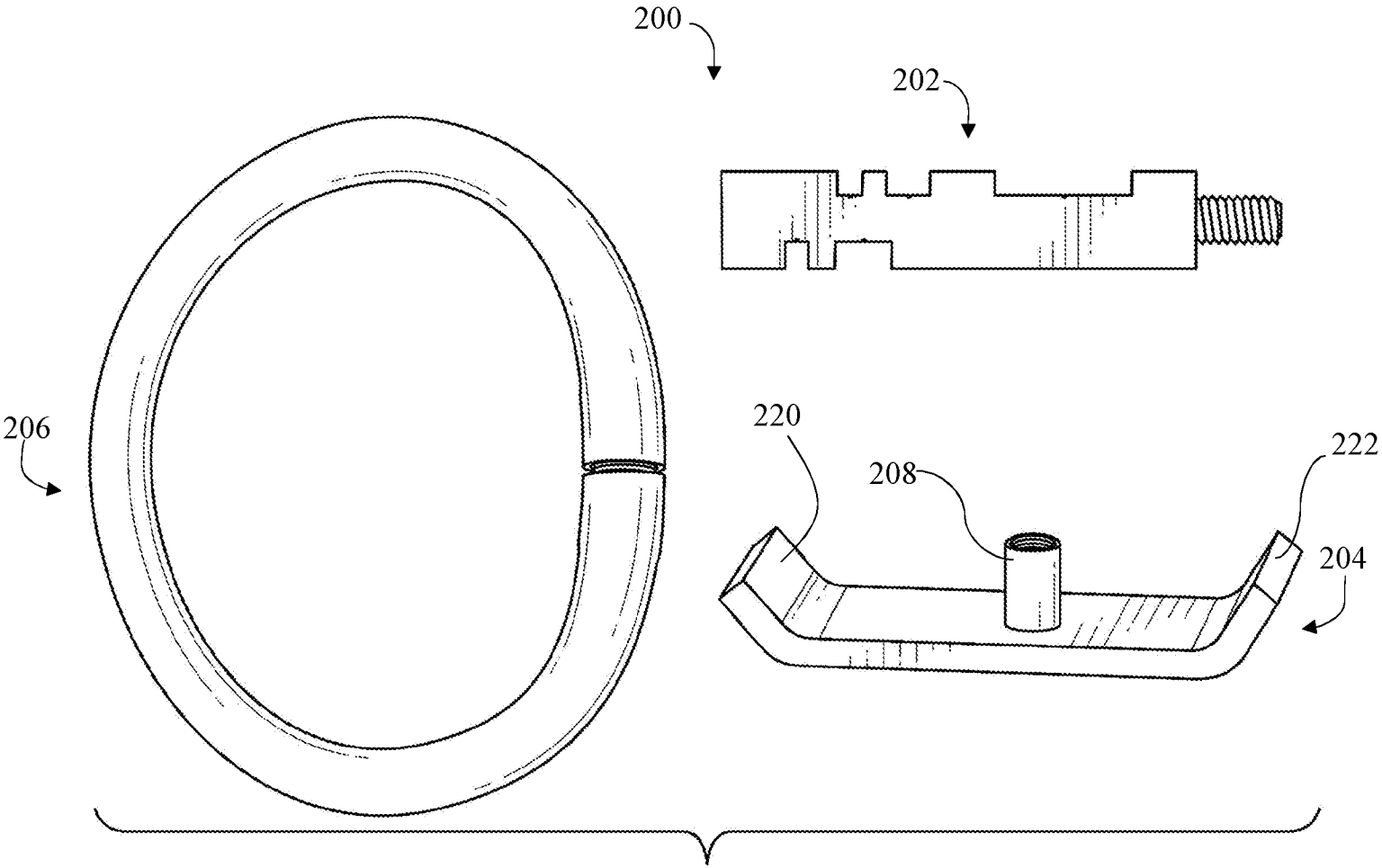
FIG. 2 illustrates a rangefinder assembly, disassembled.
Figure 3:
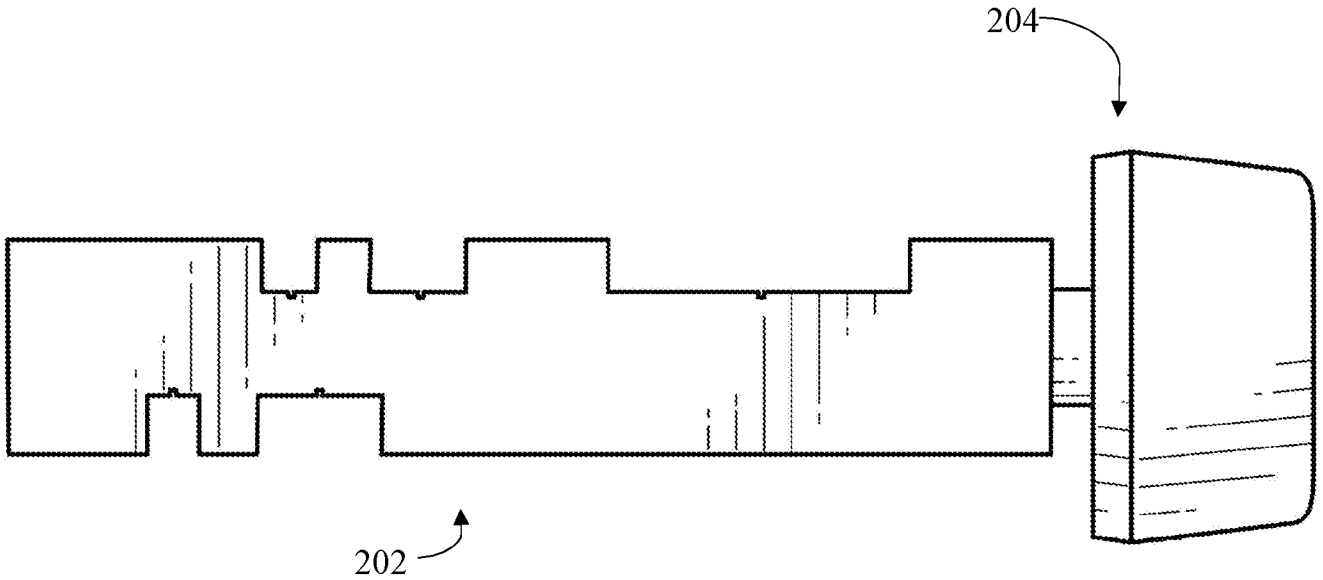
FIG. 3 is a front elevation view of a rectangular block coupled to a bracket of a rangefinder assembly.
Figure 4:
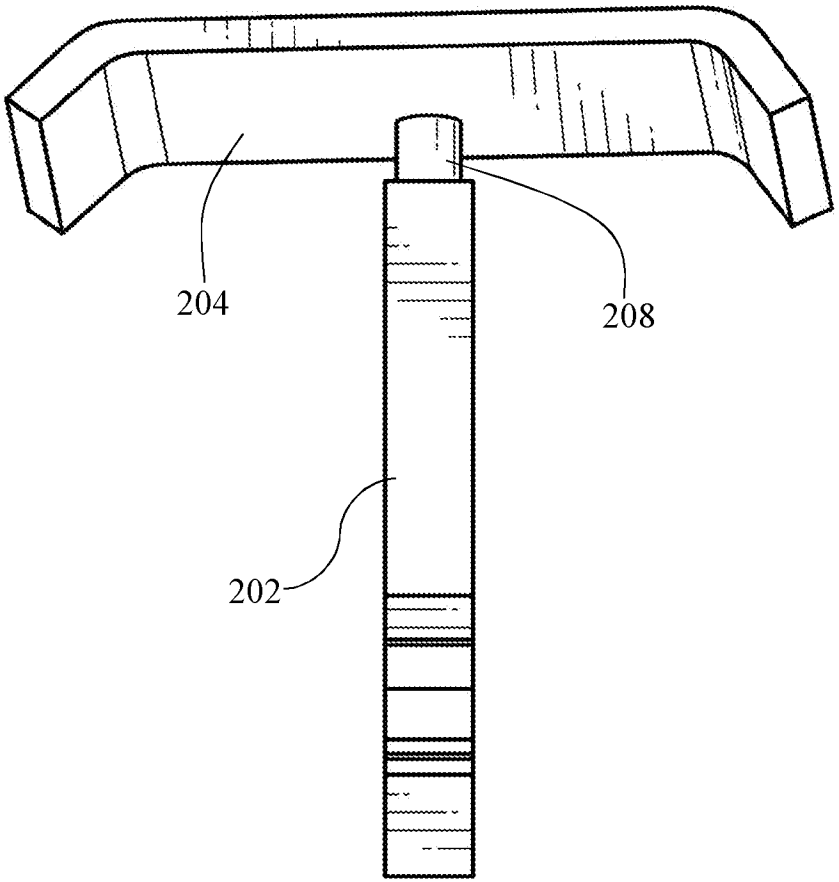
FIG. 4 is a bottom perspective view of a rectangular block coupled to a bracket of a rangefinder assembly.
Figure 5:
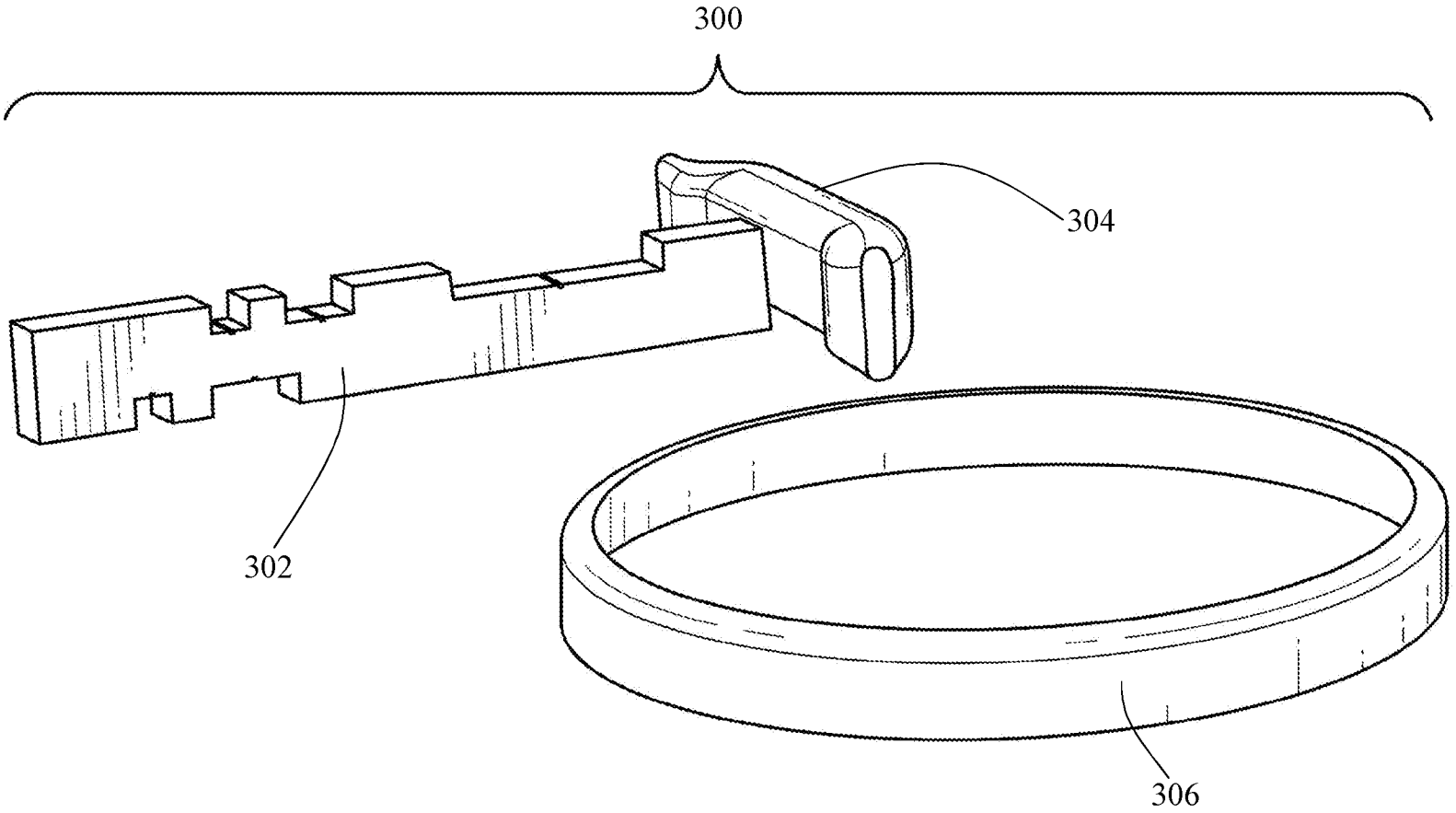
FIG. 5 is a perspective view of a rangefinder assembly.
Figure 6:
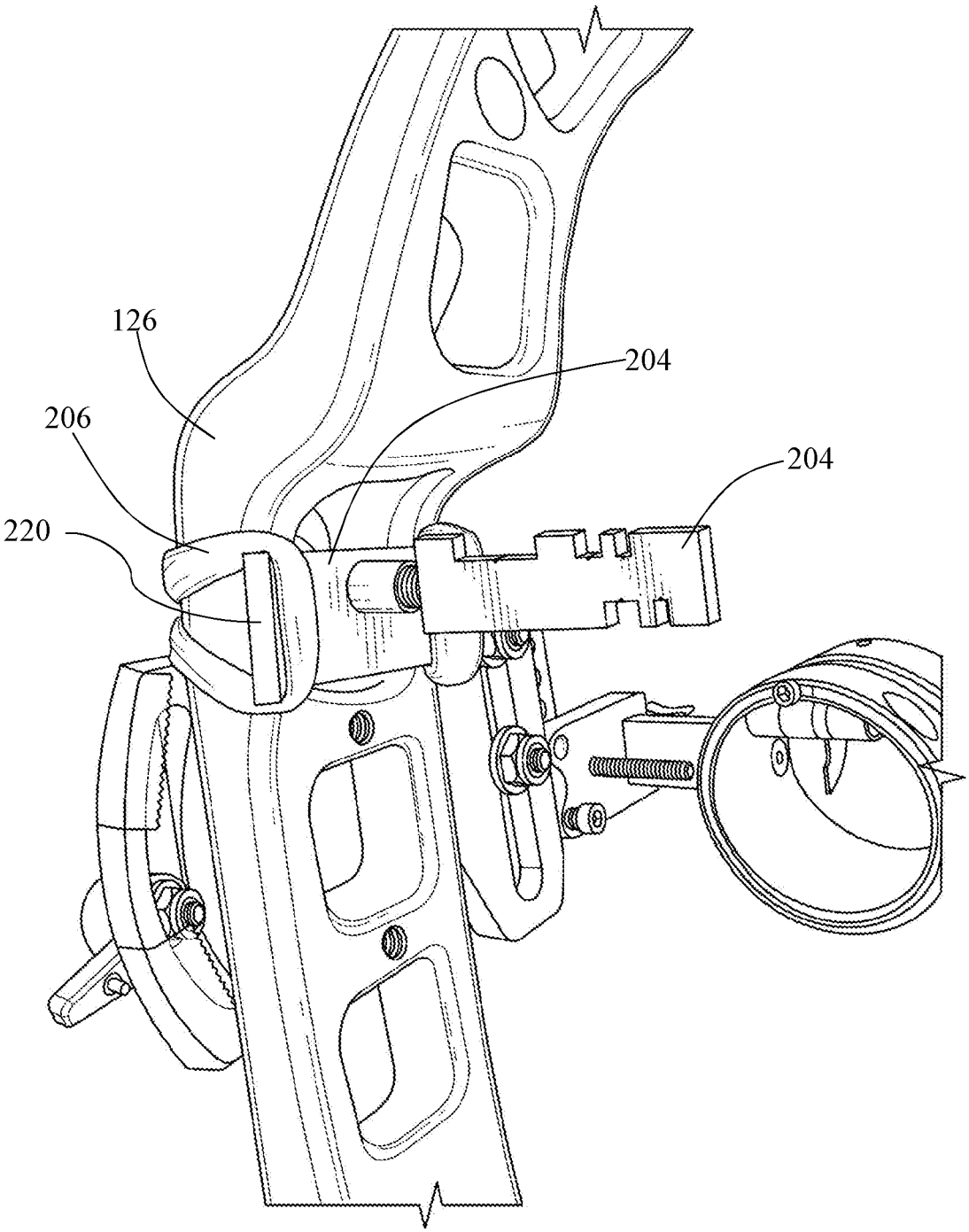
FIG. 6 is a perspective view of a rangefinder assembly coupled to the riser of a bow.

FIG. 2 illustrates a rangefinder assembly 200 comprising a rectangular block 202, bracket 204, and rubber ring 206. In this example, the bracket 204 further comprises a spacing receiver 208, which allows a user to customize the distance that the rectangular block 202 extends from the bracket 204 and riser of the bow. For example, as best shown in FIG. 6, the o-ring 206 engages the first end 220 of the bracket 204, the o-ring 220 extending around the riser 126 and engaging the second end 222 (not visible in this view). The rectangular block 202 may be rotated to extend farther away from the riser 126, or may be threaded closer thereto. Further, the rectangular block 126 may also be rotated 180 degrees so that the notches on the bottom of the rectangular block are located on the top for ease of determining distance when the animal is in the frontal position instead of broadside. FIG. 3 illustrates a front elevation view of a rectangular block 202 coupled to the bracket 204. FIG. 4 illustrates a bottom view of the rectangular block 202 coupled to the bracket 204. FIG. 5 illustrates a rangefinder assembly 300 comprising a rectangular block 302, bracket 304, and rubber ring 306. As shown, the bracket 304 may include a rubber coating to protect the riser of the bow. The rubber ring 306 may also be formed from one continuous piece of material. It will be appreciated that numerous materials may be used for manufacturing and securing the rangefinder assembly disclosed herein.

Exemplary embodiments are described in the preceding paragraphs. No element, act, or instruction used in this description should be construed as important, necessary, critical, or essential unless explicitly described as such. While the mathematical formula described above is integral to the design calculations for developing and setting the distance-determination markings of the rangefinder, the present invention is not merely outdoor recitation of a mathematical formula or abstract idea alone, but the invention instead rather uses the formula as a stepping-stone in creation of an inventive optical tool for real-time use by hunters and sports enthusiasts during a rapid activity posing fleeting opportunities. As such, the invention is the tool itself and the methods of use thereof rather than merely contributory ideas incorporated into its design and development. Note that although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A rangefinder assembly for a bow, comprising:

a rectangular block, comprising:

at least one notch on a top side corresponding to body length of a target animal;

at least one notch on a bottom side corresponding to body width of the target animal;

a bracket for coupling the rectangular block to a riser of the bow.

2. The rangefinder assembly of claim 1, wherein the rectangular block comprises a threaded end for threadably coupling to the bracket.

3. The rangefinder assembly of claim 1, wherein the bracket further comprises an elastic for coupling to the riser.

4. A rangefinder assembly for a bow, comprising:

a rectangular block, comprising:

at least one notch on a top side corresponding to body length of a target animal;

at least one notch on a bottom side corresponding to body width of the target animal; and a threaded protrusion for coupling to a bracket;

the bracket comprising a threaded aperture for receiving the threaded protrusion of the rectangular block, and an o-ring for coupling the bracket to a riser of the bow.

5. A method of using a rangefinder assembly for a bow to determine the distance of a target animal, the method comprising:

coupling the rangefinder assembly to a riser of the bow;

drawing the string of the bow and sighting the rangefinder assembly such that a rectangular block of the rangefinder assembly is positioned beneath a target animal, the distal end of the rectangular block being aligned with a first end of the target animal's body;

identifying the opposite, second end of the target animal's body on the rectangular block and corresponding notches;

determining distance of the target animal based upon the position of the second end of the target animal's body in relation to the notches on the rectangular block.

* * * * *